US005279142A

United States Patent [19]

Kaiser

[11] Patent Number: 5,279,142

[45] Date of Patent: Jan. 18, 1994

[54] HYDROSTATICALLY DEFORMING A HOLLOW BODY

[75] Inventor: Wilhelm Kaiser, Sundern, Fed. Rep. of Germany

[73] Assignee: HDE Metallwerk GmbH, Menden, Fed. Rep. of Germany

[21] Appl. No.: 927,397

[22] PCT Filed: Jan. 31, 1992

[86] PCT No.: PCT/DE92/00063

§ 371 Date: Sep. 23, 1992

§ 102(e) Date: Sep. 23, 1992

[87] PCT Pub. No.: WO92/13655

PCT Pub. Date: Aug. 20, 1992

[30] Foreign Application Priority Data

Feb. 1, 1991 [DE] Fed. Rep. of Germany ..... 4103079

[51] Int. Cl.[5] ..... B21D 22/10

[52] U.S. Cl. ..... 72/61; 72/58

[58] Field of Search ..... 72/58, 59, 61, 62

[56] References Cited

U.S. PATENT DOCUMENTS

| | | | |
|---|---|---|---|
| 2,938,562 | 5/1960 | Watts . | |
| 3,625,040 | 12/1971 | De Gain . | |
| 3,704,983 | 12/1972 | Tellot | 72/59 |
| 4,467,630 | 8/1984 | Kelly | 72/62 |
| 4,751,836 | 6/1988 | Breese | 72/61 |
| 4,951,492 | 8/1990 | Vogt | 72/61 |

FOREIGN PATENT DOCUMENTS

| | | | |
|---|---|---|---|
| 250838A2 | 1/1988 | European Pat. Off. . | |
| 347369A2 | 6/1989 | European Pat. Off. . | |
| 1855909 | 8/1963 | Fed. Rep. of Germany . | |
| 84231 | 6/1980 | Japan | 72/61 |
| 80127 | 3/1990 | Japan | 72/59 |

OTHER PUBLICATIONS

Industrie-Anzeiger No. 20 of Mar. 8, 1984, Year 10, pp. 16, 17.

*Primary Examiner*—David Jones

*Attorney, Agent, or Firm*—Herbert Dubno; Andrew Wilford

[57] ABSTRACT

An apparatus for pressure deforming a hollow workpiece having a tubular end portion has a die formed with a cavity adapted to receive the workpiece with the end portion of the workpiece projecting out of the die and a fitting movable along an axis toward and away from the die and formed with a seat sealingly engageable in a feed position over the projecting end portion of the workpiece. An annular self-tightening gland in the seat circumferentially engages in the feed position around the projecting end portion of the workpiece. A passage opening in the seat into the hollow workpiece when the fitting is engaged over the projecting end portion serves for pressurizing an interior of the workpiece and thereby deforming it outward against an inner surface of the die and for pressing the gland radially tightly against the workpiece and against the fitting.

13 Claims, 1 Drawing Sheet x
y
II
T
A

HYDROSTATICALLY DEFORMING A HOLLOW BODY

FIELD OF THE INVENTION

The invention relates to an apparatus for hydrostatically deforming hollow bodies of cold-deformable material inside a cavity of a die with at least one feed for the pressurized fluid in the hollow bodies.

BACKGROUND OF THE INVENTION

In the above-described type of apparatus (see *Industrie-Anzeiger* No. 20 of Mar. 8, 1984/10 yr. pages 16 and 17) tubular hollow parts of cold-deformable metal, for instance 16 MnCr 5, are deformed by the application of high internal hydrostatic pressure. Added to the high hydrostatic internal pressure there is a particular axial pressure that is effective on the end surfaces. This axial pressure and the simultaneous effect of the internal pressure have the result that the wall of the hollow body conforms to the surface of the mold or die.

In practice a straight tube is positioned in the separation plane between upper and lower die halves and the die is closed. Between the upper and lower die halves there is however sufficient space for two diametrally opposite coaxial arranged horizontal rams whose free end faces confront and engage the tube to be deformed. The deformation takes place by feeding pressurized fluid into the interior of the tube while simultaneously exerting axial pressure by pushing the two rams toward each other.

With the known hydrostatic deformation it is possible to produce parts with uniform shape around their circumference, parts with sectoral deformation, and also parts with uniform and sectoral deformation combined.

The advantage of hollow parts produced in this manner is primarily that, as for instance with chill casting, undercut internal spaces can be produced which could not be produced by machining or could only be done with complicated tools (for instance by spark erosion). In addition the known hollow parts—in contrast to hollow parts produced by machining—are relatively light and as a result of the cold forming from the deforming when the fibers are properly oriented are particularly strong like forged goods.

Nonetheless the known internal high-pressure deformation has been found disadvantageous because a certain minimum thickness of the wall of the hollow body cannot be exceeded. This is mainly due to the fact that the tubular bodies must be made stiff enough to resist a relatively high pressure exerted on their ends, which can only be achieved with a certain minimum wall thickness.

In addition the known internal high-pressure deformation can only be used with parts where the axial force coincides exactly to the centerline of the tube and of the die. In this manner it is possible to produce substantial lateral sectoral deformations for producing, for example, crosspieces or T-pieces. In this case the longitudinal axis extends in accordance with the die's sectoral produced outward deformation transversely to the common force lines of the rams and of the tube (see *Industrie-Anzeiger* op. cit. page 17, FIGS. 4 and 8).

With the known internal high-pressure deformation it is possible to produce a certain number of shapes which however always lie within the framework of common lines of force of the rams and the tube to be deformed, thus for a straight basic shape.

Finally the known device (see *Industrie-Anzeiger* op. cit.) is disadvantageous because it is difficult to operate as a result of its rigidity required by the axial forces of the rams.

OBJECTS OF THE INVENTION

Starting from the above-described known device (see *Industrie-Anzeiger* op. cit.), it is an object of this invention to make the known device such that it is substantially simplified and is easier to operate and permits an easier replacement of workpieces.

SUMMARY OF THE INVENTION

According to the invention this object is achieved in that feeding is effected by a feed fitting movable back and forth relative to the hollow body held in the die arrestable in the feed position, conducting the pressurized liquid, and having a feed opening shiftable over a holding region of the hollow body projecting outside the die cavity and engaging axially over the holding region in the feed position and engaging therearound by means of a liquid-pressure actuated sealing gland.

Unlike the known devices (see *Industrie-Anzeiger* op. cit.) the apparatus according to the invention needs no special means (for example a ram) for producing a particular axial pressure. On the contrary, the hydrostatic deformation corresponding to the invention takes place solely through the effect of the pressurized fluid by means of stretch deformation.

In order that the holding region or the holding regions of the hollow body are limitedly axially shiftably received by the feed fitting, the internal pressure created by the pressurized fluid inside the hollow body to be shaped only presses the walls of the hollow body on the surfaces of the die and thus "draws" material from the axially shiftably received hollow-body holding regions into the die cavity.

The apparatus according to the invention can cycle very quickly. It requires merely that the hollow body to be deformed be laid in the die, which can for example be done automatically by means of a loading robot, whereupon the respective feed fittings are moved translatorily inward toward the die and thus ar slid over the cylindrical holding regions of the hollow body. As soon as the hydraulic fluid fed in through the feed fitting is put under pressure, the gland becomes very tight on the outer surface of the hollow-body holding regions and automatically tightens itself.

As soon as the hydrostatic deformation is complete and the hydrostatic internal pressure is cut off, the gland is unloaded so that the feed fitting can be moved back to free the deformed hollow body and the region around it o the die.

An annular groove seal has been shown to be advantageous for the gland according to the invention when it is made out of a substantially incompressible material.

A particularly advantageous embodiment of a gland consists of a cast polyurethane resin with a Shore A hardness of more than 90, as for example 93–95.

Self-centering of the feed fitting on the hollow-body holding portion is achieved according to further features of the invention when the feed opening is generally funnel shaped and bounded by an axially outwardly opening frustoconical inner surface.

Preferably the feed opening forms part of a coupling nut engaging over a sleeve body, the gland being held between the coupling nut and the sleeve body.

A precise guiding of the feed fitting onto the hollow-body holding region is obtained according to the invention when a substantially cylindrical inner surface is contiguous with the frustoconical inner surface.

A particularly advantageous embodiment of the invention is that at least the cylindrical inner surface, preferably also the frustoconical inner surface, is provided with a gritty hard-metal layer. This is formed by a spark-discharge tungsten-carbide layer with a hardness of about 80 to 82 HRc.

It has been determined that the service life of seal sleeves when working stainless steel leaves much to be desired. Since the cylindrical inner surface of the feed opening is provided with a gritty hard-metal layer and the cylindrical inner surface surrounds the cylindrical holding region of the tubular hollow body closely, axially extending grooves are formed in the outer surface of the hollow-body holding region along its surface. This takes place while the cylindrical region of the feed opening covered with the gritty hard-metal layer is slid over the holding region. These axial grooves effect at a deformation pressure of more than 800–1000 bar a gripping hold of the material of the gland on the outer surface of the holding region. This gripping hold prevents a slipping of the material of the gland at pressures that exceed 800–1000 bar. Such high pressures are necessary for the hydrostatic deformation of stainless steel. Basically the above-given feature of the invention allows one to master hydrostatic internal pressures of more than 3000 bar.

According to a further feature of this invention the feed fitting is hydraulically and/or pneumatically driven reciprocally. This is advantageously carried out in that the feed fitting coaxial to the cylindrical holding region of the hollow body is held coaxially on a free piston-rod end of a pneumatic and/or hydraulic cylinder unit.

BRIEF DESCRIPTION OF THE DRAWING

Preferred embodiments of the invention are shown in the drawing where.

SPECIFIC DESCRIPTION

Figures 1, 2:
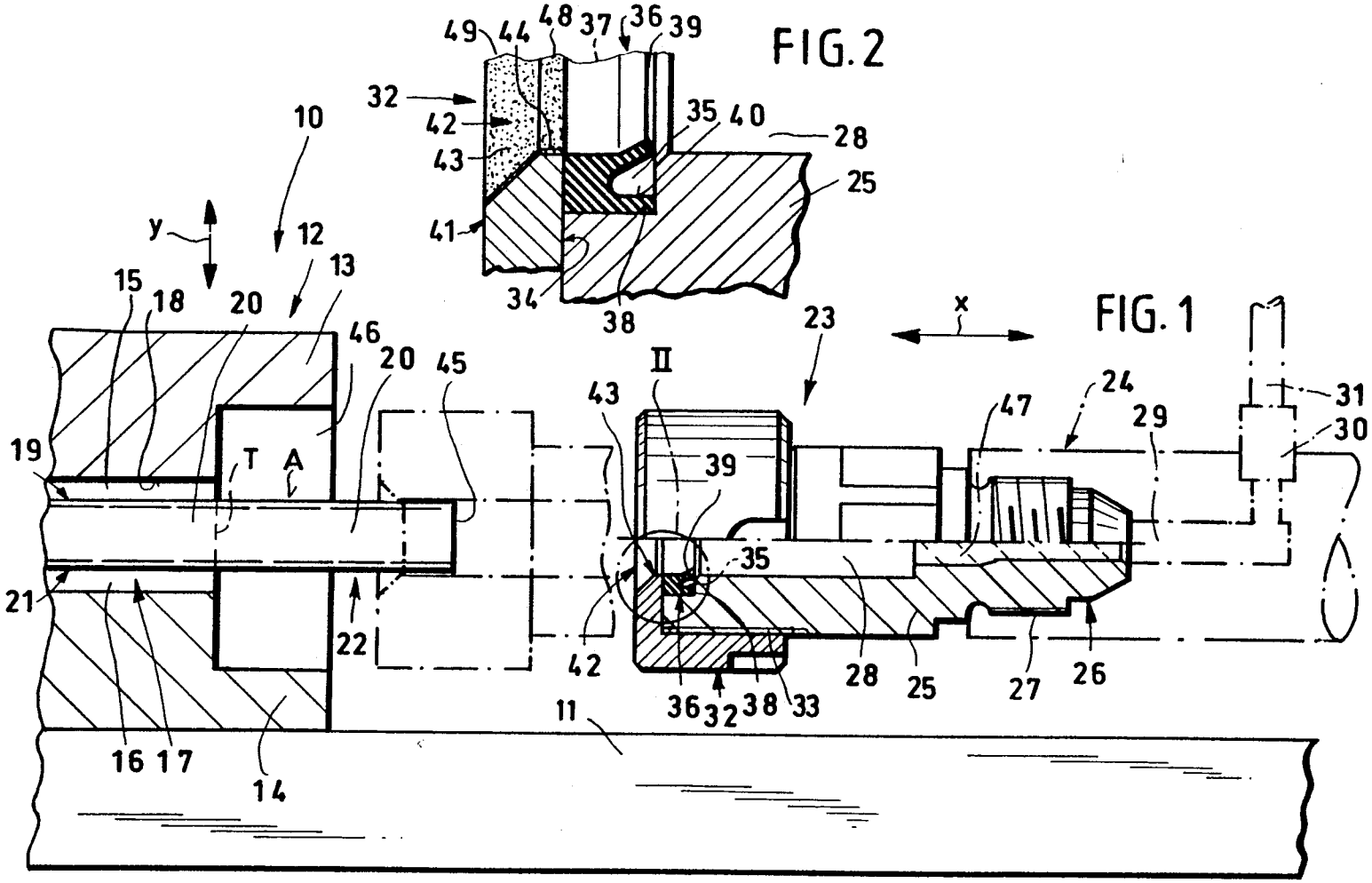
FIG. 1 is a die partly shown in vertical section on a press table and which is associated with a longitudinally sectioned feed fitting.
FIG. 2 is a large-scale detail view corresponding the region circled at II in FIG. 1.

The apparatus partly shown in FIG. 1 for hydrostatically deforming hollow bodies is generally shown at reference 10.

A die 12 which is formed of an upper die half 13 and a lower die half 14 is fixed on a press table 11.

The upper die half 13 and lower die half 14 form an upper cavity 15 and a lower cavity 16 which together form a common cavity 17. The surface 18 of the cavity 17 corresponds to the surface shape of a tubular hollow body 19 once it is hydrostatically enlarged inside the cavity 17.

The interior of the hollow body 19 is indicated at 20.

Whereas the lower die half 14 is releasably fixed so as not to move on the press table 11, the upper die half 13 can be moved up and down as indicated at arrow y. To this end the upper die half 13 is releasably fixed on an unillustrated upper press part.

Left of the dot-dash separation line T of FIG. 1 there is a deformation region 21 and to the right of the separation line T a holding region 22 of the tubular hollow body 19. The cross-section of the holding region 22 is generally circular.

A feed fitting 23 is arranged coaxially aligned with the end of a piston rod 24 shown in dot-dash lines of a hydraulically powered piston-cylinder unit. The entire feed fitting 23 is thus rotation-symmetrical as is the end of the piston rod 24.

The feed fitting 23 has a sleeve body 25 whose right-pointing extension 26 has an external screwthread 27 which is screwed in fluid- and pressure-tight fashion into an internal screwthread of the piston rod 24.

The feed fitting 23 has an internal passage 28 opening at both its ends for transmitting pressurized hydraulic fluid (for example an emulsion for hydraulic purposes). An L-shaped passage 29 in the piston rod 24 opens into the passage 28. The piston-rod connection 30 of the passage 29 is connected to a tubular high-pressure conduit 31 which leads to an unillustrated high-pressure source for the pressurized liquid.

A coupling nut 32 is screwed at 33 on an external screwthread of the sleeve body 25. The end surfaces 34 of the coupling nut 32 and the front end regions of the passage 28 of the sleeve body 25 form a circular internal groove 35 in which a seal ring, in fact a C-section gland 36, is tightly received.

The gland 36 has a circular base 37 unitarily formed with two seal lips 38 and 39 which form between themselves a circular groove 40 which is open backward, that is toward the liquid connection 30.

The radially extending plate wall 41 of the coupling nut 32 forms a feed opening 42 which is formed by a frustoconical inner surface 43 and a cylindrical inner surface 44.

The surfaces 43 and 44 are provided with respective gritty hard-metal layers 49 and 48 which are formed of tungsten-carbide particles and have a hardness of about 82 HRc. The tung-sten-carbide particles are applied by spark discharge and are internally bonded with the coupling nut 32 made of hardened steel.

The operation of the apparatus shown in FIGS. 1 and 2 is as follows:

The feed fitting 23 with the piston rod end 24 is moved translatorily along the direction indicated at double-headed arrow x.

The feed fitting 23 is shifted along x toward the left and first comes into the intermediate position shown in dot-dash lines where the open end 45 of the tubular body 19 is passed. The feed fitting 23 is shifted further along x toward the left until the coupling nut 32 engages snugly in the recess 46 of the die. The piston rod 24 with the feed fitting 23 are then blocked in this unillustrated feed position against any movement in direction x. This takes place in a simple manner in that the hydraulic working pressure in the hydraulic cylinder whose piston rod 24 is shown is stationary. Finally fluid is fed via the path 31, 30, 28 into the interior 20 of the tubular body 19. The hydrostatic internal pressure increases at a filling pressure of about 65–80 bar to a deformation pressure of about 1500 bar whereupon in this arrangement the hydrostatic deformation should stop.

During shifting of the feed fitting 23 toward the holding region 22 of the tubular hollow body 19 the gritty hard-metal coating 48 present on the cylindrical inner surface 44 of the nut 32 produces axial longitudinal scratches in the outer surface A of the holding region 22 of the hollow body 19. These axial scratches cause the gland 36 to catch internally on the outer surface A of the hollow body 19.

This catching prevents a slipping or creeping of the material of the gland 36 along the outer surface A of the tubular hollow body 19. Without such precautions there is a tendency to creep at pressures above 800–100 bar. Such pressures, which can reach 3000 bar and more, are particularly necessary for deforming stainless steel. The frustoconical inner surface 43 serves for the automatic centering of the holding region 22 inside the feed opening 42. The hard-metal layer 49 of the frustoconical inner surface 43 works against wear of the coupling nut 32.

The gland 36 is formed of an elastomeric cast polyurethane resin having a Shore A hardness of 93 marketed under the trade name "Vulkollan" of Bayer AG, DE-5090 Leverkusen.

By way of completeness it should be noted that pressurized liquid can be fed into both ends of the hollow body 19 from identical feed fittings 23. When fed in at on end in addition to the feed fitting 23, a blind socket 23 is used which has no pressure-fluid feed since the passage 28 has at one end at 47 a plug. The passage 28 serves for the blind fitting 23 as well as for the feed fitting 23 for sliding in of the hollow-body holding region without axial stress.

I claim:

1. An apparatus for pressure deforming a hollow workpiece having a tubular end portion, the apparatus comprising:

a die formed with a cavity adapted to receive the workpiece with the end portion of the workpiece projecting out of the die;

a fitting movable along an axis toward and away from the die and formed with a seat engageable in a feed position over the projecting end portion of the workpiece;

an annular self-tightening C-section gland in the seat open axially away from the die and circumferentially engaged in the feed position around the projecting end portion of the workpiece, the gland having an outer lip lying against the fitting and annular lip lying against the projecting end portion of the workpiece; and means including a passage opening in the seat into the hollow workpiece when the fitting is engaged over the projecting end portion for pressurizing an interior of the workpiece and thereby deforming it outward against an inner surface of the die and for simultaneously pressurizing a space between the lips of the gland and thereby pressing the inner lip of the gland radially tightly against the workpiece and against the fitting.

2. The apparatus defined in claim 1 wherein the gland is made of a flexible but substantially incompressible material.

3. The apparatus defined in claim 2 wherein the material is a polyurethane resin.

4. The apparatus defined in claim 3 wherein the resin has a Shore A hardness of at least 90.

5. The apparatus defined in claim 1 wherein the seat has an outer generally frustoconical surface portion flowing axially toward the die.

6. The apparatus defined in claim 5 wherein the seat has a substantially cylindrical inner surface portion having an outer edge at an inner edge of the frustoconical outer portion.

7. The apparatus defined in claim 6 wherein at least the inner surface portion of the sleeve is provided with gritty hard-metal lining.

8. The apparatus defined in claim 6 wherein the gritting lining is made of tungsten-carbide particles.

9. The apparatus defined in claim 1 wherein the seat is complementary to the projecting end portion.

10. The apparatus defined in claim 1 wherein the seat is formed with a really inwardly open groove holding the gland.

11. The apparatus defined in claim 1, further comprising means including a fluid-powered actuator for displacing the fitting along the axis toward and away from the die.

12. A method of pressure deforming a hollow workpiece having a tubular end portion, the method comprising the steps of:

fitting the workpiece into a die formed with a cavity adapted to receive the workpiece with the end portion of the workpiece projecting out of the die;

displacing along an axis toward the die a fitting formed with a seat having a shape conforming substantially to an outer surface of the projecting end potion and lined with a gritty material until the stage engages in a feed position over the projecting end portion of the workpiece and an annular self-tightening gland in the seat circumferentially engages around the projecting end portion of the workpiece;

scoring the outer surface of the end portion with the gritty material while displacing the fitting over the end portion and thereby increasing the frictional hold of the gland on the outer surface; and pressurizing an interior of the workpiece and thereby deforming it outward against an inner surface of the die and pressing the gland radially tightly against the workpiece and against the fitting.

13. An apparatus for pressure deforming a hollow workpiece having a tubular end portion, the apparatus comprising:

a die formed with a cavity adapted to receive the workpiece with the end portion of the workpiece projecting out of the die;

a fitting movable along an axis toward and away from the die and formed with a seat engageable in a feed position over the projecting end portion of the workpiece and having an inner surface shaped complementarily to the projecting end portion and provided with a gritty lining capable of scratching the projecting end portion, whereby the gritty lining roughens an outer surface of the end portion as the fitting is engaged over the projecting end portion;

an annular self-tightening gland in the seat circumferentially engaged in the feed position around the projecting end portion of the workpiece; and means including a passage opening in the seat into the hollow workpiece when the fitting is engaged over the projecting end portion for pressurizing an interior of the workpiece and thereby deforming it outward against an inner surface of the die and for pressing the gland radially tightly against the workpiece and against the fitting.

* * * * *